United States Patent [19]

Sabol

[11] Patent Number: 4,584,770

[45] Date of Patent: Apr. 29, 1986

[54] PINKING SHEARS WITH ADJUSTABLE TIP PRESSURE

[75] Inventor: Albert Sabol, Statesboro, Ga.

[73] Assignee: Cooper Industries, Inc., Houston, Tex.

[21] Appl. No.: 754,206

[22] Filed: Jul. 11, 1985

Related U.S. Application Data

[63] Continuation of Ser. No. 546,525, Oct. 28, 1983, abandoned.

[51] Int. Cl.[4] ..... B26B 13/00

[52] U.S. Cl. ..... 30/267; 30/230; 411/301; 411/403; 411/437

[58] Field of Search ..... 30/266–267, 30/270, 207, 213, 214, 230, 254–262; 411/402, 403, 405, 427, 437, 276, 301

[56] References Cited

U.S. PATENT DOCUMENTS 1,523,393 1/1925 Britton ..... 411/276
1,885,754 11/1932 Nachtigall ..... 30/267
3,170,237 2/1965 Weidauer ..... 30/267 X
3,749,433 7/1973 Mankowsky ..... 411/427 X

FOREIGN PATENT DOCUMENTS 521883 2/1956 Canada ..... 30/267

*Primary Examiner*—Douglas D. Watts
*Attorney, Agent, or Firm*—Wigman & Cohen

[57] ABSTRACT

Pinking shears are disclosed comprising a pair of blades having cutting teeth and tips on one end and a handle on the other end, a common pivot assembly for the pair of blades, and an adjustable ball assembly for adjusting the pressure applied at the tips of the blades. The ball assembly is mounted in one blade between the handle thereof and the pivot assembly bears against the other blade to urge the blades away from one another adjacent the handles of the shears. As a result of this arrangement, the pressure between the tips is increased and a smooth cutting action is obtained when the pinking shears are being used to cut different types of materials of varying thickness.

12 Claims, 6 Drawing Figures

PINKING SHEARS WITH ADJUSTABLE TIP PRESSURE

This application is a continuation of application Ser. No. 546,525, filed Oct. 28, 1983 now abandoned.

BACKGROUND OF THE INVENTION

The present invention relates to cutlery and, more particularly to scissors or shears having toothed or serrated blades, such as pinking shears, and means for adjusting the tip pressure of the blades.

Heretofore, one of the difficulties associated with conventional pinking scissors or shears is the inability of the prior art shear constructions to achieve a smooth cutting action along the entire length of the blades when different materials of varying thickness are cut. This is especially so at the tips or free ends of the blades farthest from the pivot point of the blades. Shears which lack the capability of achieving a quick and conventional adjustment of blade tip pressure are not practical for use in cutting differing fabric materials of widely varying thickness as is typical, for instance, in the garment making arts.

A further limitation of conventional pinking shears which are not provided with a blade tip pressure adjustment mechanism is the blade wear which occurs after a period of use and which can render the shears virtually useless for cutting materials of any thickness.

Several devices are known in the prior art for making adjustments between pinking shear blades. One such device is disclosed in U.S. Pat. No. 3,170,237 to Weidauer. This patent discloses that the pressure between the cutting blades may be adjusted by varying the force applied to a pair of dish-shaped spring washers arranged on the pivot bolt of the blades. The adjustment is accomplished by tightening the pivot nut secured to the pivot bolt. An anti-friction ball thrust bearing is provided between the blades to reduce the friction therebetween.

Another prior art device which is utilized to adjust the alignment of pinking shear blades to provide a workable relationship therebetween is disclosed in U.S. Pat. No. 2,000,852 to Langbein. The adjustment mechanism of this prior art device comprises a plurality of balls mounted between the blades on a V-shaped raised portion arranged concentrically about the pivot bolt. The balls act as a ball bearing to reduce friction between the blades and each ball is individualy adjustable by means of a screw to maintain the blades in alignment.

The prior art pinking shears disclosed in the aforesaid patents are of comparatively complex and expensive construction and require the use of an anti-friction bearing arrangement about the pivot bolt for reducing the friction between the blades.

SUMMARY AND OBJECTS OF THE INVENTION

In view of the foregoing limitations and shortcomings of the prior art devices, as well as other disadvantages not specifically mentioned above, it should be apparent that there still exists a need in the art for a simple and versatile means for adjusting the tip pressure between the blades of pinking shears and large scissors. It is, therefore, a primary objective of this invention to fulfill that need by providing pinking shears with a simple mechanism for easily and quickly adjusting the pressure between the blades, especially at the blade tips.

More particularly, it is an object of this invention to provide a simple device for adjusting the pressure between the blades of pinking shears or large scissors to adapt the shears or scissors for cutting a wide variety of materials of varying thickness.

It is another object of this invention to provide pinking shears or large scissors that are easy and economical to manufacture.

Yet another object of the invention is to provide pinking shears or large scissors in which substantial pressure can be developed between the blades to achieve a smooth cutting action without the need for an anti-friction bearing.

Briefly described, the aforementioned objects are accomplished according to the invention by providing a novel pinking shear construction which comprises a pair of blades pivoted about a common pivot assembly and having serrated or saw-toothed cutting edges extending from the pivot point to the free ends or tips of the blades. The ends of the blades opposite the tips are configured as conventional scissor handles. The common pivot bolt is fixed in non-rotatable relation to one blade by means of a tapered portion on the bolt which forms an interference fit with a bore in said blade.

A pair of spring washers is secured on the pivot bolt by means of a split pivot nut and apply pressure tending to force the blades together tightly. A ball assembly is mounted in a threaded bore in one blade at a point between the pivot axis and the handle for adjusting the pressure between the blades, especially at the blade tips. The ball assembly extends through said one blade toward the other blade and bears on the confronting flat surface thereof. By threading the ball assembly into the one blade toward the other blade, the cutting portions of the blades are urged toward one another and the tip pressure between the blades increases. Conversely, threading the ball assembly out of the blade will reduce the pressure between the blades and will permit the shears to accommodate, for instance, a thicker material.

Thus, once the blades have been assembled together with the pivot bolt, pivot nut and spring washers and the pivot nut is tightened to the appropriate blade pressure, the ball assembly may be used thereafter to either increase or decrease blade pressure depending on the type and thickness of the material to be cut. Of course, when necessary, the blade pressure may be adjusted in larger increments by tightening or loosening the pivot nut.

DETAILED DESCRIPTION OF A PREFERRED EMBODIMENT

Figure 1:
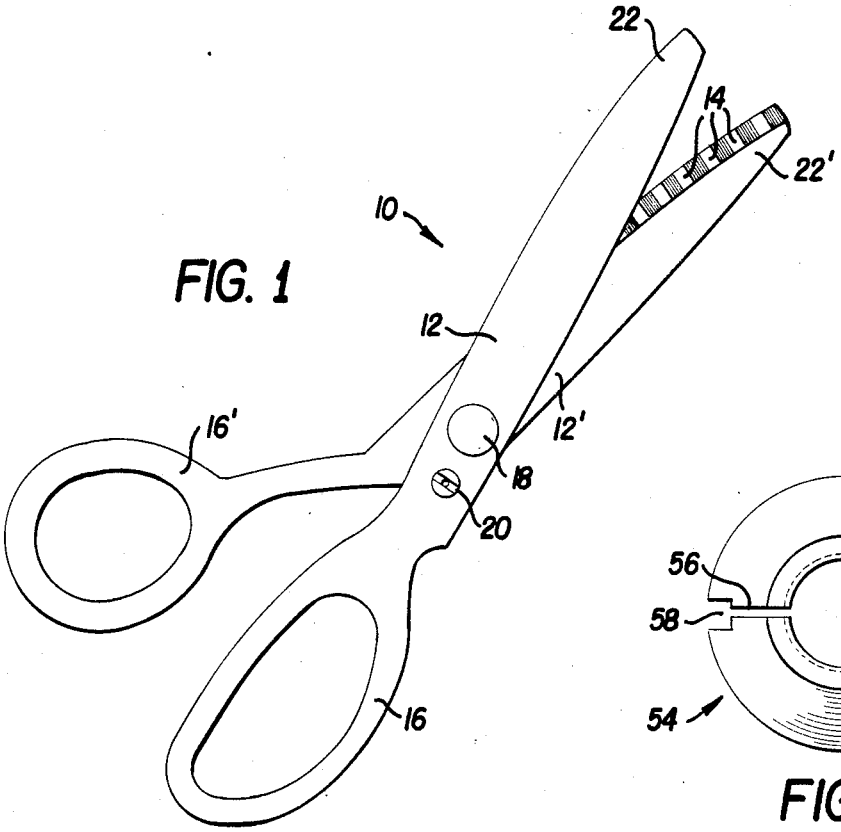
FIG. 1 is a plan view of the pinking shears of the present invention in a partially opened condition.

Referring now in detail to the drawings wherein like parts are designated by like reference numerals throughout, there is illustrated in FIG. 1 a pair of pinking shears according to the present invention which are designated generally by reference numeral 10. The shears of FIG. 1 are shown in a partially opened condition with blades 12,12' each having cutting surfaces and teeth 14 at one end and a handle 16, 16' at the other end. The blades 12 are secured together in a pivotable relationship by a pivot assembly 18 which is interposed between the blades 12, 12' and the handles 16, 16'.

A ball assembly 20 is mounted in the blade 12 adjacent the pivot assembly 18 on the side thereof toward the handle 16, i.e., between the pivot assembly 18 and the handle 16. The ball assembly 20 provides adjustable control of the pressure between the free ends or the tips 22, 22' of the blades 12, 12' in a manner to be described in further detail hereinafter.

Figure 6:
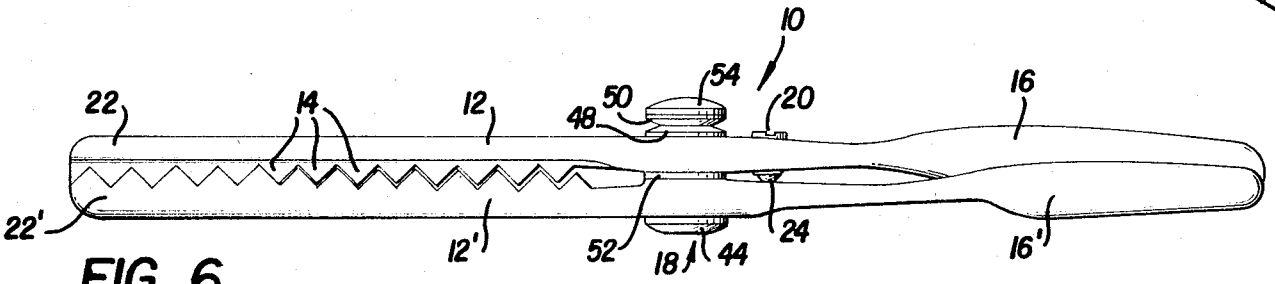
FIG. 6 is a side elevation view similar to FIG. 2, illustrating the position of the teeth of the blades when the pinking shears of the present invention are in a completely closed condition.

As best seen in FIG. 6, when the shears are in the closed position, there is a slight inward curvature of the blades 12, 12' along the longitudinal extent of the blades from the pivot assembly 18 toward the blade tips 22, 22'. In the closed position, the cutting teeth 14 adjacent the pivot assembly 18 are slightly disengaged by reason of the pressure exerted at the tips 22, 22'. It is the pressure exerted at the tips 22, 22' that is adjusted by the present invention.

Figure 5:
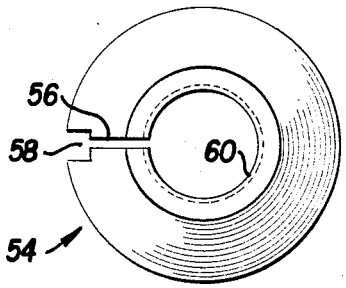
FIG. 5 is a top plan view of the pivot nut shown in FIG. 4.
Figure 4:
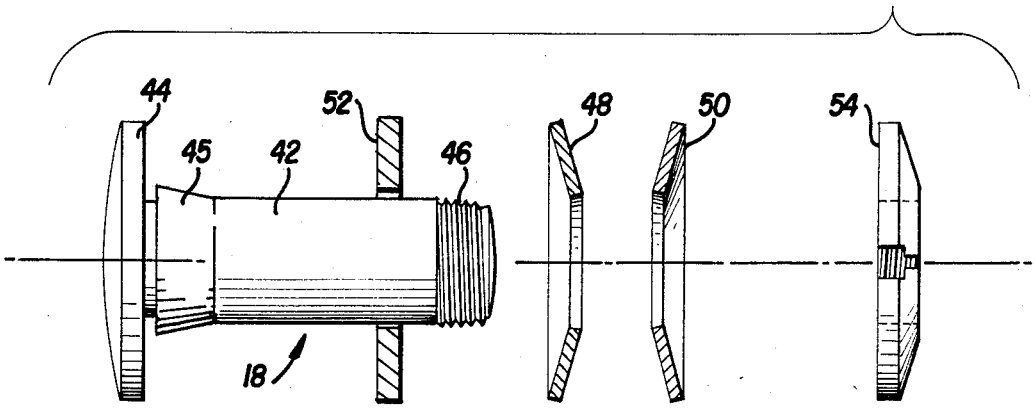
FIG. 4 is an exploded view of a pivot bolt, a nut, and associated elements for aiding in the provision of adjustable control of the pressure between the blade tips.
Figure 2:
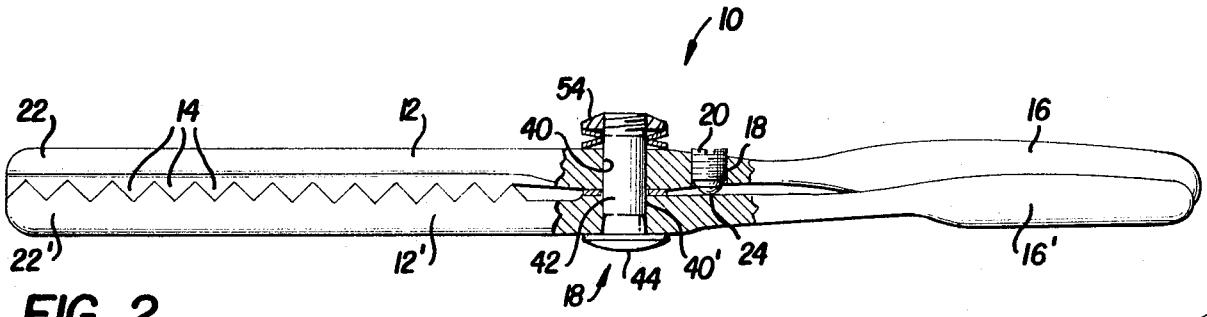
FIG. 2 is a side elevation view, partly broken, of the partially opened pinking shears of FIG. 1, showing the arrangement of the pivot bolt and ball assembly.

Referring now to FIGS. 2, 4 and 5, the details of construction of the pivot assembly 18 will be seen. The pivot assembly comprises a pivot bolt 42 having a flattened head 44 at one end and a threaded portion 46 at the opposite or shank end of the bolt. An intermediate tapered portion 45 of the shank is provided closely adjacent the head 44.

In the pivot area of the blades 12, 12', there are provided bores 40, 40' for receiving the bolt 42. The bore 40' receives the tapered portion 45 on the shank of the bolt 42. The bolt 42 is pressed into the bore 40' to form an interference fit therewith and to thereby secure the bolt in non-rotatable relationship to the blade 12'.

A flat spacer washer 52 is located on the bolt 42 interposed between the confronting surfaces of the blades 12, 12'. Washer 52 establishes the normal alignment and spacing between the blades which may be varied by changing the thickness of the washer.

A pair of spring washers 48, 52 are assembled to the pivot bolt with the convex surfaces thereof in confronting relation and are secured to the bolt by a split nut 54 engaging the threaded portion 46 of the shank. The nut 54 is tightened by means of a wrench (not shown) which engages a notch or socket 58 in the periphery of nut 54. Although the socket 58 is preferably constructed as a widened portion of the slot 56 of the split nut 54, it will be appreciated that the socket may be formed at any angular position along the periphery of the nut 54.

The nut 54 has a central opening 60 and is internally threaded so that it may engage with the threaded end portion 46 of bolt 42. The threaded portion 46 has oversized threads which, in cooperation with the radial slot 56, cause the nut 54 to expand slightly and thereby lockably engage the bolt 42 as the nut is tightened. The nut 54 is tightened to place the spring washers 48, 50 in compression and create sufficient engagement between the teeth 14 of blades 12, 12' to allow smooth cutting action under normal conditions.

Figure 3:
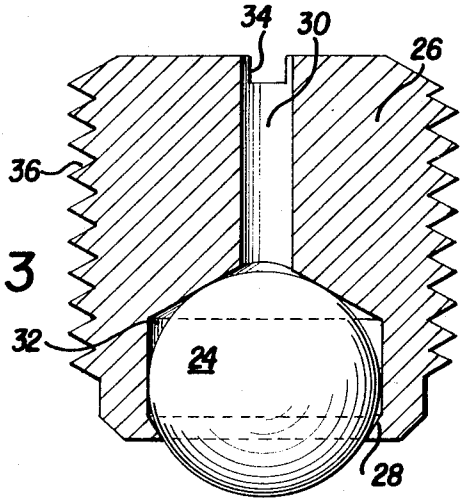
FIG. 3 is a detail view, in cross-section, of the ball assembly for providing adjustable control of the pressure between the blade tips.

As shown in FIG. 3, ball assembly 20 comprises a metal housing 26 having external threads 36 and a counterbored cavity 32 at one end thereof into which a steel ball 24 is inserted. Preferably, ball 24 is secured in cavity 32 by forcing the lip 28 of the housing inwardly to retain the ball in place in a freely rollable relation in the cavity. The lip 28 may be formed about the ball by spinning, rolling, swaging or any other suitable manufacturing process.

A central lubricant passageway 30 extends axially through the housing 26 and communicates with the cavity 32. A light lubricant, such as machine oil, is inserted in the passageway and lubricates the ball to permit free rotation of the ball within the cavity. On the end of housing 26 opposite the cavity 32, there is provided a diametrical slot 34 which is adapted to receive a screwdriver blade for installation, removal and adjustment of the ball assembly 20.

Blade 12 is provided with a threaded bore 38 between the pivot assembly 18 and handle 16 for threadably receiving the ball assembly 20. The ball assembly 20 is screwed into threaded bore 38 with a screwdriver until the ball 24 bears against the confronting flat surface of blade 12' adjacent the handle 16'.

During use of the pinking shears 10 according to the invention, the pivot assembly 18 and the ball assembly 20 cooperate to control the pressure between the blades 12, 12' and blade tips 22, 22' as the user operates the handles 16, 16' to the open and closed positions. The pressure between the blades and blade tips can be readily adjusted to suit the user when cutting different kinds and thickness of material so that a smoother and more uniform cutting action can be achieved. It is possible, for instance, to increase the pressure between the blades by either using a wrench to tighten or loosen the split nut 54 of the pivot assembly 18 or a screwdriver to adjust the position of the ball assembly 20 and create a greater pressure between the blade tips 22, 22'.

Substitution of a spacer 52 having a greater or lesser thickness between the blades 12, 12' can also be used to adjust the pressure exerted between the blades 12, 12' because the thickness of the spacer 52 controls the normal spacing between the cutting teeth 14 on the blades 12, 12'.

As will be understood by those skilled in the art, the arrangement of the pivot assembly and ball assembly according to the present invention may be employed with other types of shears and large scissors.

Although only a preferred embodiment is specifically illustrated and described herein, it will be appreciated that many modifications and variations of the present invention are possible in light of the above teachings and within the purview of the appended claims without departing from the spirit and intended scope of the invention.

What I claim is:

1. A pair of shears for cutting material, comprising:

a pair of blades, each blade having cutting surfaces, a tip on one end, and a handle on the other end;

pivot means for pivotably mounting the blades to one another at a point intermediate the tips and handles, said pivot means having resilient means for automatically adjusting the blades to account for variations of a first magnitude in material thickness, said pivot means comprising a pivot bolt, a pair of spring washers, a spacer, and a nut mounted on the pivot bolt, said pivot bolt having a head at one end, a threaded portion at the other end having oversized threads, and a tapered intermediate portion adjacent the head of the bolt, said tapered portion being non-rotatably received in a bore in one of said blades, said nut having internal threads, a radial slot and socket means in the outer periphery thereof for receiving a wrench, whereby the nut is adapted to expand as it is threaded onto the oversized threads of the bolt to lock the same; and means mounted in one of said blades between the pivot means and the handle for manually adjusting the blades to account for variations of a second magnitude larger than the first magnitude in material thickness.

2. The shears according to claim 1, wherein the one blade includes a threaded bore for receiving the manual adjusting means.

3. The shears according to claim 1, wherein the manual adjusting means comprises a ball and a ball housing having a cavity for retaining the ball therein in a freely rotatable relation with respect to the housing.

4. The shears according to claim 3, wherein the ball retaining cavity has a conical base for providing minimal surface contact with the ball.

5. A pair of shears, comprising:

a pair of blades, each blade having cutting surfaces, a tip on one end and a handle on the other end;

pivot means for pivotably mounting the blades to one another at a point intermediate the tips and handles, said pivot means having resilient means for maintaining pressure between the blades, said pivot means comprising a pivot bolt having oversized threads, a pair of spring washers on the pivot bolt, and a nut having a radial slot and socket means in the outer periphery thereof for receiving a wrench whereby the nut is adapted to expand as it is threaded onto the oversized threads of the bolt; and means mounted in one of said blades between the cutting blades at the tips of the pair of blades, said pressure adjusting means comprising a ball and a housing means having a bore with a conical bottom for retaining the ball therein, the ball of said pressure adjusting means bearing against the other of said pair of blades.

6. The shears according to claim 5, wherein said pivot bolt has a head at one end, a threaded portion at the other end having oversized threads, and a tapered intermediate portion adjacent the head of the bolt, said tapered portion being non-rotatably received in a bore in one of said blades.

7. The shears according to claim 5, wherein each blade of the pair of blades has a slight inward curvature in the longitudinal direction from therpivot means toward the tip of each blade.

8. The shears according to claim 5, wherein said housing comprises a central bore for receiving a lubricant for said ball and a slot in the end of said housing opposite said ball for rotating said housing in said threaded bore.

9. A pair of shears, comprising:

a pair of blades, each blade having cutting edges, a tip on one end of the blade and a handle on the other end thereof, wherein each blade of the pair of blades has a slight inward curvature in the longitudinal direction from a pivot means toward the tip of each blade and one of the blades comprises a threaded bore;

pivot means for pivotably securing the pair of blades together, the pivot means comprising a pivot bolt, a pair of spring washers on the bolt, a solid spacer having opposing surfaces arranged on the bolt between the pair of blades so that each of the spacer surfaces contacts a respective blade, and a nut threaded onto the pivot bolt for securing said blades together, said pivot bolt having oversized threads, and said nut having a radial slot and socket means in the outer periphery thereof for receiving a wrench whereby the nut is adapted to expand as it is threaded onto the oversized threads of the bolt; and an adjustable ball assembly means comprising a ball and a housing means having a bore with a conical bottom for retaining the ball therein, said ball assembly means being mounted in one blade of said pair of blades between the pivot means and the handle thereof, the ball of said ball assembly means bearing against the other blade of said pair of blades;

the housing means being mounted in the one blade in an adjustable manner so that the bearing force between the pair of blades is adjustable;

wherein said adjustable ball assembly means and said pivot means coact to control the magnitude of pressure between the tips of the blades.

10. The shears according to claim 9, wherein one of said blades comprises a threaded bore for receiving the pressure adjusting means.

11. The shears according to claim 10, wherein said housing comprises a central bore for receiving a lubricant for said ball and a slot in the end of said housing opposite said ball for rotating said housing in said threaded bore.

12. The shears according to claim 9, wherein said shears are pinking shears, said cutting edges comprising cutting teeth.

* * * * *